US008866694B2

(12) United States Patent
Togashi

(10) Patent No.: US 8,866,694 B2
(45) Date of Patent: Oct. 21, 2014

(54) PORTABLE TERMINAL

(75) Inventor: Daisuke Togashi, Yokohama (JP)

(73) Assignee: Kyocera Corporation, Kyoto (JP)

( * ) Notice: Subject to any disclaimer, the term of this patent is extended or adjusted under 35 U.S.C. 154(b) by 708 days.

(21) Appl. No.: 13/130,647

(22) PCT Filed: Feb. 25, 2009

(86) PCT No.: PCT/JP2009/053461

§ 371 (c)(1),
(2), (4) Date: Jul. 28, 2011

(87) PCT Pub. No.: WO2010/061641

PCT Pub. Date: Jun. 3, 2010

(65) Prior Publication Data

US 2011/0273357 A1 Nov. 10, 2011

(30) Foreign Application Priority Data

Nov. 26, 2008 (JP) ..... 2008-301127

(51) Int. Cl.
*H01Q 3/24* (2006.01)
*H01Q 1/24* (2006.01)
*H01Q 1/48* (2006.01)

(52) U.S. Cl.
CPC . *H01Q 1/243* (2013.01); *H01Q 1/48* (2013.01)
USPC ..... 343/876; 455/575.1; 455/475.7; 455/556.1

(58) Field of Classification Search
CPC ..... H01Q 3/24; H01Q 1/243; H01Q 1/521; H04M 1/0202
USPC ..... 343/876; 455/575.1, 475.7, 556.1
See application file for complete search history.

(56) References Cited

U.S. PATENT DOCUMENTS 7,079,877 B2 7/2006 Shoji et al.
7,737,897 B2 * 6/2010 Takeuchi et al. ..... 343/702

(Continued)

FOREIGN PATENT DOCUMENTS

JP 2000197126 A1 7/2000
JP 2002335180 A 11/2002

(Continued)

OTHER PUBLICATIONS

Office Action from a foreign patent office for a counter-part foreign application dated Dec. 18, 2012 for Japanese Patent Application No. JP 2010-540397.

(Continued)

*Primary Examiner* — Allyson Trail
(74) *Attorney, Agent, or Firm* — John S. Sopko; Hoffman & Baron, LLP

(57) ABSTRACT

Provided is a portable terminal wherein reduction of an antenna gain can be suitably suppressed. The portable terminal is provided with a circuit section (33), which is arranged on an operating section side case section (2) or a display section side case section (3), and has a ground section (31), a power feed section (32) and a signal processing section (38) connected to the power feed section (32); a first conductive section (34) arranged on the operating section side case section (2); a second conductive section (35) arranged on the display side case section (3); a selection section (36) configured to select a first state, wherein the first conductive section (34) and the ground section (31) are electrically connected and the second conductive section (35) and the power feed section (32) are electrically connected, or a second state, wherein the first conductive section (34) and the power feed section (32) are electrically connected and the second conductive section (35) and the ground section (31) are electrically connected; and a control section (37) which controls the selection of the first state or the second state performed by the selection section (36).

9 Claims, 7 Drawing Sheets

(56) References Cited

U.S. PATENT DOCUMENTS

| | | | | |
|---|---|---|---|---|
| 2003/0220128 | A1 | 11/2003 | Harano | |
| 2005/0239519 | A1* | 10/2005 | Saitou et al. | 455/575.1 |
| 2006/0192714 | A1* | 8/2006 | Koyama et al. | 343/702 |
| 2006/0194462 | A1* | 8/2006 | Hashizume | 439/164 |
| 2008/0143609 | A1 | 6/2008 | Mashima et al. | |
| 2008/0143614 | A1* | 6/2008 | Park et al. | 343/702 |
| 2008/0174508 | A1* | 7/2008 | Iwai et al. | 343/850 |
| 2008/0300028 | A1* | 12/2008 | Uejima et al. | 455/575.3 |
| 2010/0248775 | A1* | 9/2010 | Mikkelsen et al. | 455/556.1 |
| 2010/0265148 | A1* | 10/2010 | Ollikainen et al. | 343/749 |
| 2012/0044124 | A1* | 2/2012 | Sanz et al. | 343/893 |

FOREIGN PATENT DOCUMENTS

| | | | |
|---|---|---|---|
| JP | 2003338769 | A | 11/2003 |
| JP | 2004-56426 | A | 2/2004 |
| JP | 2004363863 | A | 12/2004 |
| JP | 2005-6091 | A | 1/2005 |
| JP | 2006050136 | A | 2/2006 |
| JP | 3889423 | B2 | 3/2007 |
| JP | 2007104468 | A | 4/2007 |
| JP | 2008-85869 | A | 4/2008 |
| WO | 2006062198 | A1 | 6/2006 |

OTHER PUBLICATIONS

English Machine Translation of JP 2004-056426.
English Machine Translation of JP 2005-6091.
English Machine Translation of JP 2008-85868.

* cited by examiner

PORTABLE TERMINAL

CROSS-REFERENCE TO RELATED APPLICATIONS

This application is the National Stage of International Application No. PCT/JP2009/053461, filed Feb. 25, 2009, which claims the benefit of Japanese Application No. JP 2008-301127, filed Nov. 26, 2008, the contents of all of which are incorporated by reference herein.

TECHNICAL FIELD

The present invention relates to a portable terminal having a first body and a second body.

BACKGROUND ART

Among portable terminals, there is a folding-type terminal that is configured from a first body and a second body and is configured to be able to transition from an opened state and a closed state via a hinge portion according to a usage mode. Such a folding-type portable terminal has a communication function of communicating externally via an antenna. Herein, when used by a user while performing communication, the amplification drops due to the influence of the human body according to the usage mode thereof, and thus the antenna of the portable terminal becomes unable to secure high communication quality.

Therefore, a technique to secure high communication quality irrespective of the usage mode has been proposed by supplying power to one of a first conductive portion disposed in the first body and a second conductive portion disposed in the second body, and setting the other one to ground (grounded state). For example, according to Patent Document 1, a technique is disclosed that can suppress a decline in the amplification of the antenna even if a portion is covered by the hand of the user by employing either one of the first conductive portion and the second conductive portion as an antenna, since the surface area is wide compared to a rod-type antenna.

Patent Document 1: Japanese Unexamined Patent Application, Publication No. 2002-335180

DISCLOSURE OF THE INVENTION

Problems to be Solved by the Invention

However, a technique to further suppress a decline in the amplification of antennas is required in a conventional portable terminal exemplified in Patent Document 1.

The present invention has been made taking the aforementioned such problems into account, and an object thereof is to provide a portable terminal that can suitably suppress a decline in the amplification of antennas, while employing either one of a first conductive portion and a second conductive portion in the antenna.

Means for Solving the Problems

In order to solve the above-mentioned problems, a portable terminal according to the present invention includes: a circuit portion that is disposed in either one of the first body and the second body, and including a ground portion, an electric power supply portion, and a signal processing unit connected to the electric power supply portion; a first conductive portion disposed in the first body; a second conductive portion disposed in the second body; a selector portion configured to be able to select between a first state electrically connecting the first conductive portion and the ground portion as well as electrically connecting the second conductive portion and the electric power supply portion, and a second state electrically connecting the first conductive portion and the electric power supply portion as well as electrically connecting the second conductive portion and the ground portion; and a control unit that controls selection between the first state and the second state by way of the selector portion.

In addition, it is preferable for the above portable terminal to further include a detection unit that detects a predetermined parameter, in which the control unit controls selection between the first state and the second state by way of the selector portion based on the predetermined parameter detected by way of the detection unit.

Moreover, in the above portable terminal, it is preferable for the first conductive portion and the second conductive portion to be configured to be able to resonate with a signal in a predetermined frequency band, the detection unit to detect a first resonance sensitivity of the second conductive portion with a signal in the predetermined frequency band in the first state and a second resonance sensitivity of the first conductive portion with a signal in the predetermined frequency band in the second state as the predetermined parameter, and the control unit to compare the first resonance with the second resonance sensitivity detected by way of the detection unit, select the first state by way of the selector portion in a case of the first resonance being higher than the second resonance sensitivity, and select the second state by way of the selector portion in a case of the first resonance sensitivity being lower than the second resonance.

Additionally, in the above portable terminal, it is preferable for the detection unit to be configured to be able to detect a contact state, temperature or brightness as the predetermined parameter, the control unit to select the first state by way of the selector portion in a case of having detected by way of the detection unit that the first body is being contacted, and the first body is a temperature within a predetermined temperature range or a periphery of the second body is a brightness no more than a predetermined brightness, and to select the second state by way of the selector portion in a case of having detected by way of the detection unit that the second body is being contacted, the second body is a temperature within a predetermined temperature range or a periphery of the second body is a brightness no more than a predetermined brightness.

In addition, it is preferable for the above portable terminal to further include a first antenna that intermittently receives at a predetermined period, in which the control unit controls selection between the first state and the second state by way of the selector portion at a period corresponding to the predetermined period.

Furthermore, it is preferably for the above portable terminal to further include a function executing unit, in which the control unit controls selection between the first state and the second state by way of the selector portion, based on a function being executed by way of the function executing unit.

In addition, it is preferable for the above portable terminal to further include an operation unit, in which the control unit selects the first state when a function accompanying an operation to the operation unit is being executed by the function executing unit.

Moreover, it is preferable for the above portable terminal to further include a connector capable of connecting with an external device, in which the control unit selects the first state when the external device is connected to the connector.

Additionally, it is preferable for the above portable terminal to further include a voice output unit that is disposed in the second body and outputs sound, in which the control unit selects the second state when sound is being output by the voice output unit.

Furthermore, it is preferable for the above portable terminal to further include a second antenna and a function executing unit that executes a function related to a signal transmitted or received by way of the second antenna, in which the selector portion wherein the selector portion is configured to be able to select a third state electrically connecting the first conductive portion and the ground portion as well as electrically connecting the second conductive portion and the ground portion, and the control unit selects the third state by way of the selector portion when a function related to a signal transmitted or received by way of the second antenna is executed by the function executing unit.

Effects of the Invention

According to the present invention, it is possible to suitably suppress a reduction in the amplification of an antenna.

EXPLANATION OF REFERENCE NUMERALS

Figure 1:
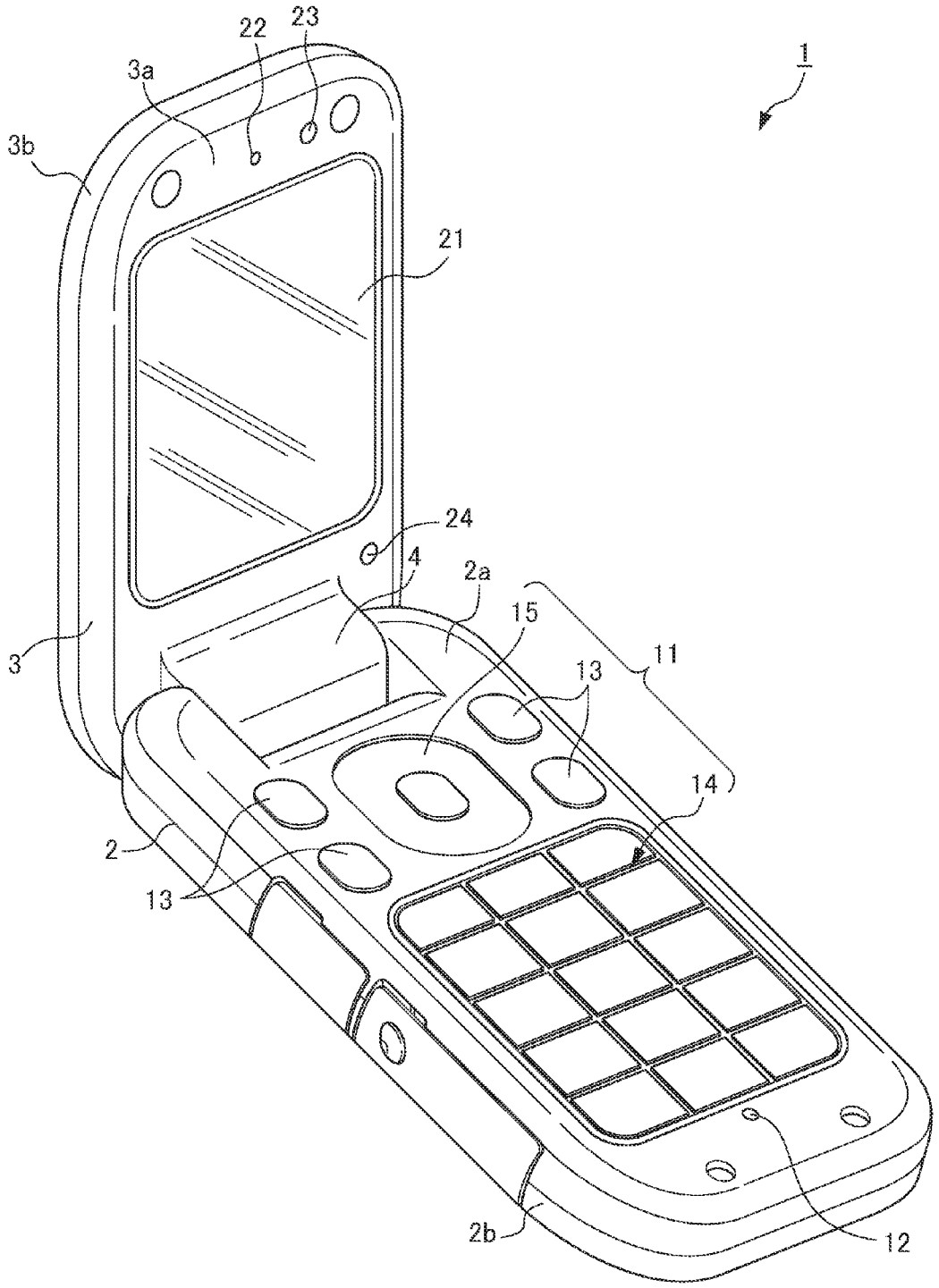
FIG. 1 is a view showing an external appearance of a cellular telephone device according to the present embodiment.

1 cellular telephone device
2 operation unit side body (first body)
3 display unit side body (second body)
33 circuit portion
34 first conductive portion
35 second conductive portion
36 selector portion
37 control unit
38 signal processing unit
39 detection unit
63 first antenna
64 second antenna
67 function executing unit

PREFERRED MODE FOR CARRYING OUT THE INVENTION

Embodiments of the present invention will be explained hereinafter. FIG. 1 shows a perspective view of the external appearance of a cellular telephone device 1, which is one example of a portable terminal according to the present invention. It should be noted that, although the cellular telephone device 1 will be explained hereinafter, the present invention is not to be limited to cellular telephone devices, and may be a PHS (Personal Handyphone System), PDA (Personal Digital Assistant), portable navigation device, notebook computer or the like, for example.

As shown in FIG. 1, the cellular telephone device 1 includes an operation unit side body 2 and a display unit side body 3. The operation unit side body 2 (first body) and the display unit side body 3 (second body) are connected such that opening and closing thereof are possible via a connection portion 5 having a hinge mechanism. More specifically, an upper end portion of the operation unit side body 2 and a lower end portion of the display unit side body 3 are connected via the connection portion 4. The cellular telephone device 1 is thereby configured such that it is possible to move the operation unit side body 2 and the display unit side body 3, which are connected via the hinge mechanism, relative to each other. That is, the cellular telephone device 1 can be in a state (opened state) in which the operation unit side body 2 and the display unit side body 3 are opened, and in a state (closed state) in which the operation unit side body 2 and the display unit side body 3 are arranged to overlap each other. Here, a closed state means a state where both housings are arranged to overlap with each other, and an opened state means a state where both housings are arranged to not overlap with each other.

An outer surface of the operation unit side body 2 is configured by a front case 2*a* and a rear case 2*b*. The operation unit side body 2 is configured so that, at its front case 2*a* side, a group of operation keys 11 and a voice input unit 12 as a microphone to which sounds produced by the user of the cellular telephone device 1 during a call are input are each exposed.

The group of operation keys 11 is configured with a function setting operation key 13 for bringing various functions such as various settings, a telephone directory function, a mail function, and the like, and an input operation key 14 for inputting numbers of a telephone number, characters of mail and the like, for example, and a determination operation key 15, which is an operation member that performs determination in various operations, scrolling in up, down, left and right directions, and the like. A predetermined function is assigned to each key constituting the group of operation keys 11 depending on the opened or closed state of the operation unit side body 2 and the display unit side body 3, various modes, the type of application running, or the like (key assigning). Then, an operation is executed according to the function assigned to each key by the user pressing each key.

The voice input unit 12 is arranged at an outer end portion side of the operation unit side body 2 opposite to the connection portion 4 side in the longitudinal direction. That is, the voice input unit 12 is arranged at the one outer end portion side when the cellular telephone device 1 is in the opened state.

On a side face of one side of the operation unit side body 2, an interface (not illustrated) for carrying out communication with external devices (e.g., a host device) is arranged. On a side face of the other side of the operation unit side body, a side key to which a predetermined function is assigned and an interface (not illustrated) with which insertion and removal of external memory are performed are arranged. The interface is covered with a cap. Each interface is covered with a cap when not in use.

Figure 3:
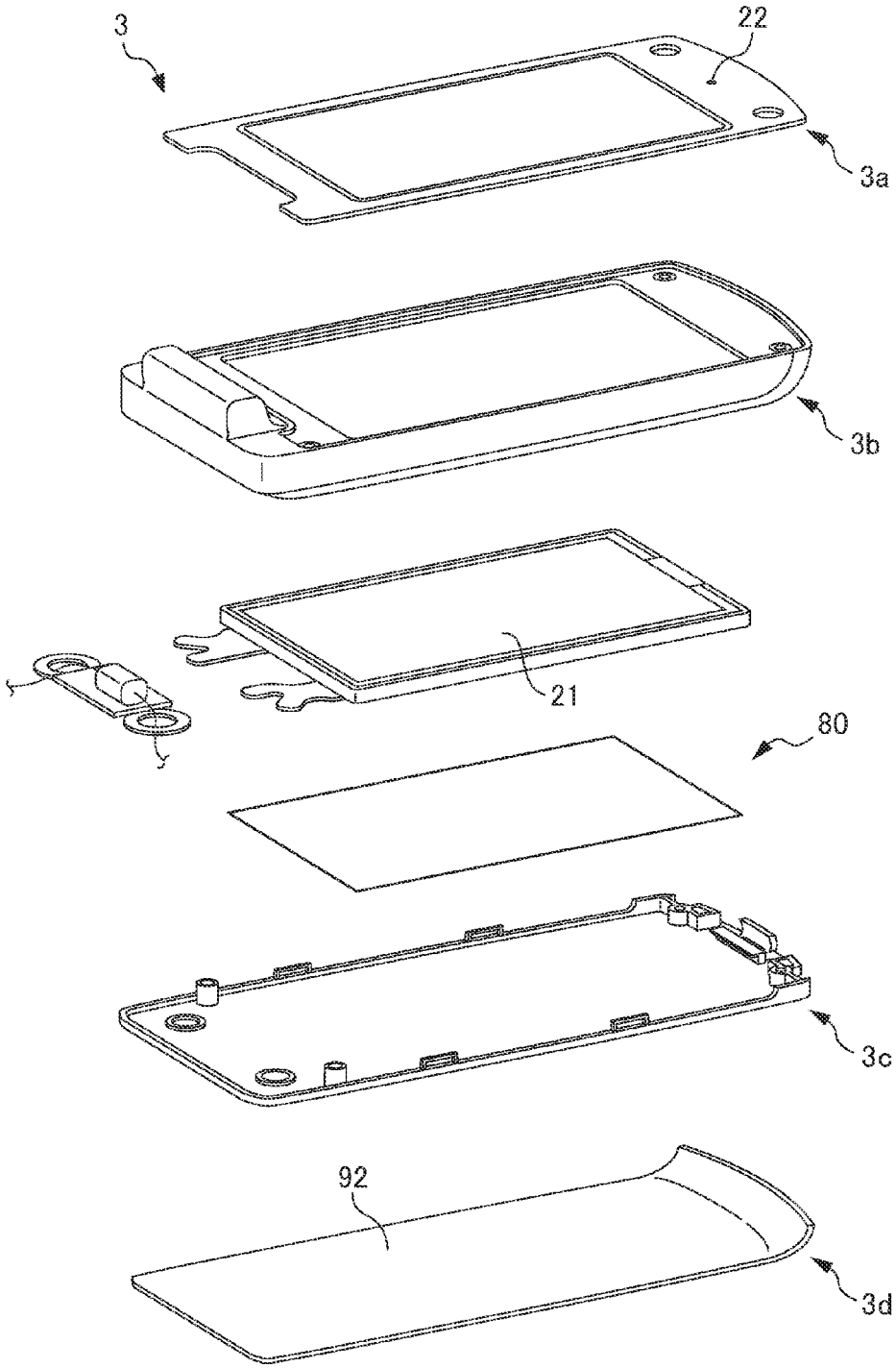
FIG. 3 is an exploded perspective view of a display unit side body of the cellular telephone device according to the present embodiment.

An outer surface of the display unit side body 3 is configured by a front panel 3*a*, a front case 3*b*, a rear case 3*c*, and a rear panel 3*d* (refer to FIG. 3). A display unit 21 for displaying a variety of information, a voice output unit 22 as a receiver that outputs sound of the other party of a call, a photographing unit 23 configured by a CCD (Charge Coupled Device) camera or the like that photographs a subject, and a speaker 24 that outputs music and the like to outside are arranged in the display unit side body 3 so as to be externally exposed. The display 21 is configured from a liquid crystal panel, a drive circuit that drives this liquid crystal panel, and a light source unit such as a back light that radiates light from a back side of this liquid crystal panel.

Figure 2:
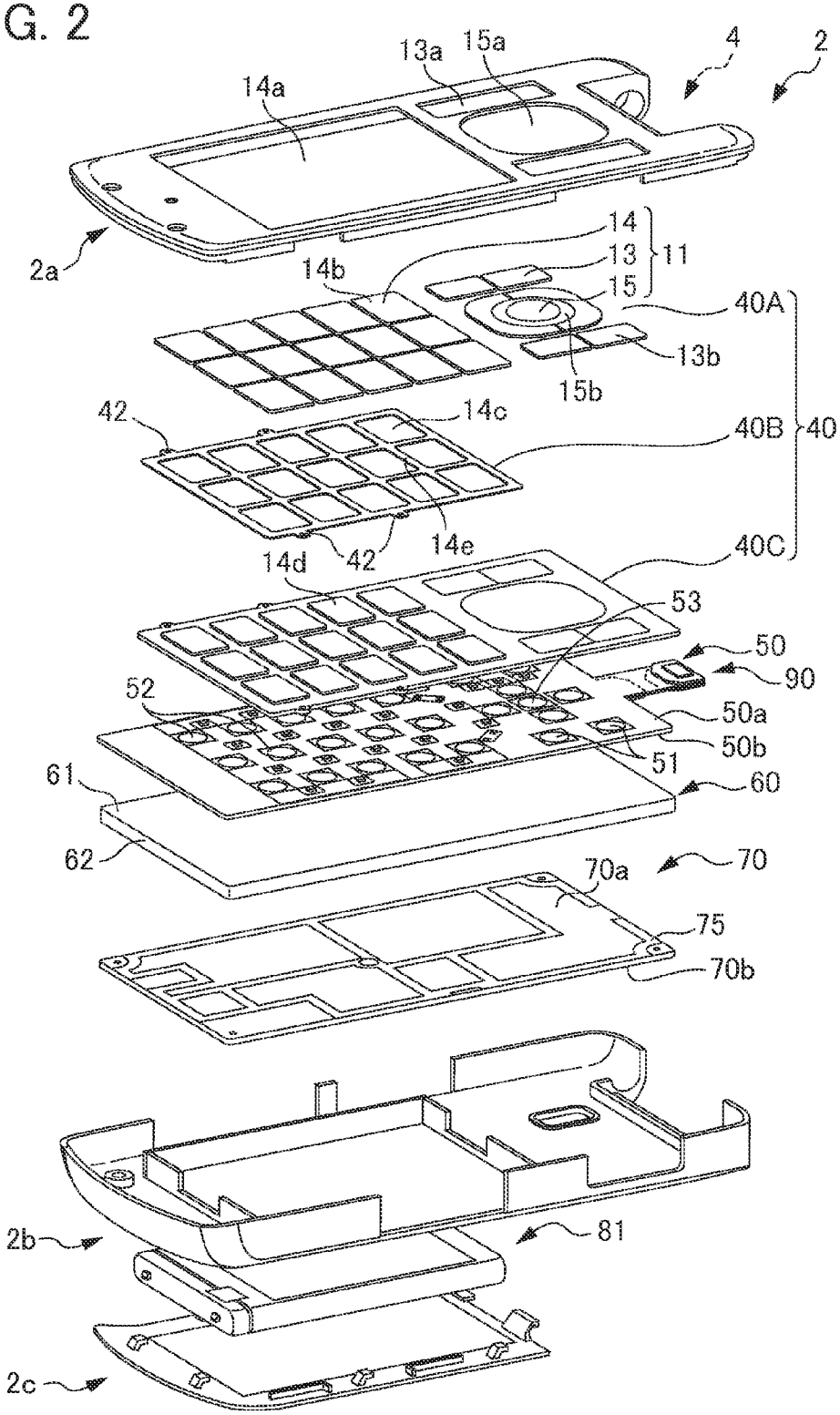
FIG. 2 is an exploded perspective view of an operation unit side body of the cellular telephone device according to the present embodiment.

FIG. 2 is an exploded perspective view of the operation unit side body 2. As shown in FIG. 2, the operation unit side body 2 includes a front case 2*a*, a key structure portion 40 (operation unit), a key substrate 50, a shielding case 60, a circuit board 70, a rear case 2*b* provided with a battery lid 2*c*, a first case member 30 and a battery 81.

The front case 2*a* and the rear case 2*b* are arranged so that their concave-shaped internal surfaces face each other and their outer circumferential edges overlap each other. In addition, the key structure portion 40, the key substrate 50 having an FPC portion 90, the shielding case 60, and the circuit board 70 are housed between the front case 2*a* and the rear case 2*b* so as to be sandwiched therebetween.

Key holes 13*a*, 14*a* and 15*a* are formed in the front case 2*a* in an internal surface that faces the display 21 of the display unit side body 3 in a state in which the cellular telephone device 1 is folded. From each of the key holes 13*a*, 14*a* and 15*a*, a pressing surface of the function setting operation key member 13*b* constituting the function setting operation key 13, a pressing surface of the input operation key member 14*b* constituting the input operation key 14, and a pressing surface of the determination operation key member 15*b* constituting the determination operation key 15 are exposed. By pressing the pressing surfaces of thus exposed function setting operation key member 13*b*, input operation key member 14*b*, and determination operation key member 15*b*, the top of a metal dome (bowl-shaped), which is described later, provided at each of the corresponding key switches 51, 52, and 53 is pressed and contacts a switch terminal to be electrically conducted to it.

The key structure portion 40 is configured with an operation member 40A, a key frame 40B as a reinforcement member, and a key seat 40C as a sheet member.

The operation member 40A is configured with a plurality of key operation members. Specifically, it is configured with a function setting operation key member 13*b*, an input operation key members 14*b*, and a determination operation key member 15*b*. Each of the operation key members constituting the operation member 40A is adhered to the key seat 40C by sandwiching the key frame 40B described later. The pressing surface on each of the operation key members adhered to the key seat 40C is arranged to be exposed outside from each of the key holes 13*a*, 14*a* and 15*a*, as described above.

The key frame 40B is a metallic plate-shaped member in which a plurality of hole portions 14*c* are formed. The key frame 40B is a reinforcement member for preventing adverse effects to the circuit board 70 or the like due to pressing of the input operation key member 14*b*. In addition, the key frame 40B is an electrically conductive member, and functions also as a member for releasing static electricity in the input operation key member 14*b*. Convex portions 14*d* formed on the key seat 40C described later are arranged to fit to a plurality of hole portions 14*c* formed in the key frame 40B. Then, the input operation key members 14*b* adheres to the convex portions 14*d*.

The key seat 40C is a sheet-shaped member made of silicone rubber having flexibility. A plurality of convex portions 14*d* are formed in the key seat 40C as described above. The plurality of convex portions 14*d* are formed on a surface of the key seat 40C on a side where the key frame 40B is to be arranged. Each of the plurality of convex portions 14*d* is formed at a position corresponding to the key switch 52 described later.

The key substrate 50 has a plurality of key switches 51, 52 and 53 arranged on a first surface 50*a*, which is a surface on a key sheet 40C side thereof. Each of the plurality of key switches 51, 52 and 53 are arranged at a position corresponding to each operation member 40A. The key switches 51, 52 and 53 arranged at the key substrate 50 have structures that have metal domes of metallic plates sterically formed so as to have a curved bowl shape. The metal dome is configured so that when the top of its bowl shape is pressed, it contacts the switch terminal formed on an electrical circuit (not illustrated) printed on the surface of the key substrate 50 and conducts electrically. In addition, a plurality of electrode wire is formed on a side of a second surface 50*b* of the key substrate 50. This key substrate 50 is electrically connected with the circuit board 70 via the FPC portion 90 as a substrate.

The shielding case 60 is a rectangular as viewed in the plane, and is a low-profile box shape with a surface thereof on a circuit board 70 side open. This shielding case 60 includes a plate portion 61, and a rib portion that projects substantially perpendicular from a peripheral edge of this plate portion 61. The shielding case 60 is arranged so that the rib portion 62 abuts a reference potential pattern layer 75 formed on the circuit board 70. The shielding case 60 is formed from a metal material, and has electrical conductivity.

The circuit board 70 has the reference potential pattern layer 75 (first conductive portion) formed on one face 70*a* thereof. In addition, various electrical components (not illustrated) such as an RF module for cellular telephone devices and an RF circuit portion 33 (circuit portion) that performs processing on high frequency signals are mounted on this circuit board 70.

FIG. 3 is an exploded perspective view of the display unit side body 3. As shown in FIG. 3, the display unit side body 3 includes a front panel 3*a*, a front case 3*b*, the display 21, a circuit board 80 to which the display 21 is connected, a rear case 3*c*, and a rear panel 3*d*. In addition, the front panel 3*a*, the front case 3*b*, the display 21, the circuit board 80, the rear case 3*c* and the rear panel 3*d* are arranged in layers in the display unit side body 3.

As shown in FIG. 3, the front case 3*b* and the rear case 3*c* are arranged so that the interior faces of concave shape face each other, and are joined together so that their outer peripheral edges overlap with each other. In addition, the display 21 and the circuit board 80 are housed so as to be sandwiched between the front case 3*b* and the rear case 3*c*. Moreover, a reference potential pattern layer (second conductive portion) is formed on the circuit board 80.

Furthermore, with the cellular telephone device 1, the circuit board 80 arranged inside of the display unit side body 3 and the circuit board 70 arranged inside of the operation unit side body 2 are electrically connected between the operation unit side body 2 and the display unit side body 3 by a flexible printed circuit board (Flexible Printed Circuits: hereinafter referred to as FPC) not illustrated.

It should be noted that, although FIG. 1 shows the form of a so-called folding-type cellular telephone device, the form of the cellular telephone device according to the present invention is not particularly limited, and may be a sliding type in which one of the bodies slides to one direction from a state where the operation unit side body 2 and the display unit side body 3 are overlapped with each other; a rotating (turning) type in which one of the bodies rotates about an axis along the overlapping direction of the operation unit side body 2 and the display unit side body 3; or the like.

The cellular telephone device 1 according to the present invention is configured with a single antenna (dipole antenna), and has a function of switching the first conductive portion 34 to the radiating element and switching the second conductive portion 35 to the grounding portion, and a function of switching the second conductive portion 35 to the radiating element and switching the first conductive portion 34 to the grounding portion under fixed conditions, by setting either side among the first conductive portion 34 arranged in the operation unit side body 2 or the second conductive portion 35 arranged in the display unit side body 3 to be the radiating element of the antenna and setting the other side as the grounding portion of the antenna.

Herein, the configuration for realizing the functions will be explained using the schematic views shown in FIGS. 4 and 5. It should be noted that, although the antenna configured by the first conductive portion 34 and the second conductive portion 35 is explained by assuming to be an antenna that receives digital terrestrial broadcasting hereinafter, for example, it is not limited thereto, and may be employed as the main antenna used in CDMA (Code Division Multiple Access) communication.

The cellular telephone device 1 has the operation unit side body 2, the display unit side body 3, the circuit portion 33, the first conductive portion 34, the second conductive portion 35, the selector portion 36, and the control unit 37. It should be noted that the first conductive portion 34 is configured by the reference potential pattern layer 75 of the circuit board 70, the shielding case 60, the electrically conductive member forming the operation unit side body 2, and the like, for example. In addition, the second conductive portion 35 is configured by the reference potential pattern layer of the circuit board 80, the shielding case (not illustrated), the electrically conductive member forming the display unit side body 3, and the like, for example.

The circuit portion 33 is arranged in either one of the operation unit side body 2 and the display unit side body 3, and has grounding portions 31*a*, 31*b*, electric power supply parts 32*a*, 32*b* and a signal processing unit 38. It should be noted that the signal processing unit 38 is configured at the same potential as the grounding portions 31*a*, 31*b* so as to have not influence on the antenna characteristics. The first conductive portion 34 is arranged in the operation unit side body 2. The second conductive portion 35 is arranged in the display unit side body 3.

The selector portion 36 is configured from a selector portion switch 36*a*, a selector portion switch 36*b* and a selector portion switch 36*c*, and is configured to be able to select a first state (state schematically shown in FIG. 4) electrically connecting the first conductive portion 34 with the grounding portion 31*a* as well as electrically connecting the second conductive portion 35 with an electric power supply part 32*a*, which is one component of the electric power supply portion 32, and a second state (state schematically shown in FIG. 5) electrically connecting the first conductive portion 34 with the electric power supply part 32*b*, which is one component of the electric power supply portion 32, as well as electrically connecting the second conductive portion 35 with the grounding portion 31*a*.

The control unit 37 controls selection of the first state and the second state by way of the selector portion 36. Herein, the first state assumes a state selected by the selector portion 36 when the user holds the operation unit side body 2. In addition, the second state assumes a state selected by the selector portion 36 when the user holds the display unit side body 3. Moreover, the signal processing unit 38 is configured to include an RF circuit that processes signals supplied from the electric power supply unit 32 or signals supplied to the electric power supply unit 32.

Next, specific selection operations by the selector portion 36 will be explained. In the first state, the control unit 37 performs control so as to select the selector portion switch 36*a* so that the second conductive portion 35 and the electric power supply part 32*a* are electrically connected, and to selected the selector portion switch 36*b* so that the electric power supply part 32*a* and the signal processing unit 38 are electrically connected, as shown in FIG. 4. By configuring in this way, the second conductive portion 35 realizes a function as the radiating element of an antenna due to being connected to the signal processing unit 38 via the electric power supply portion 32.

Figure 4:
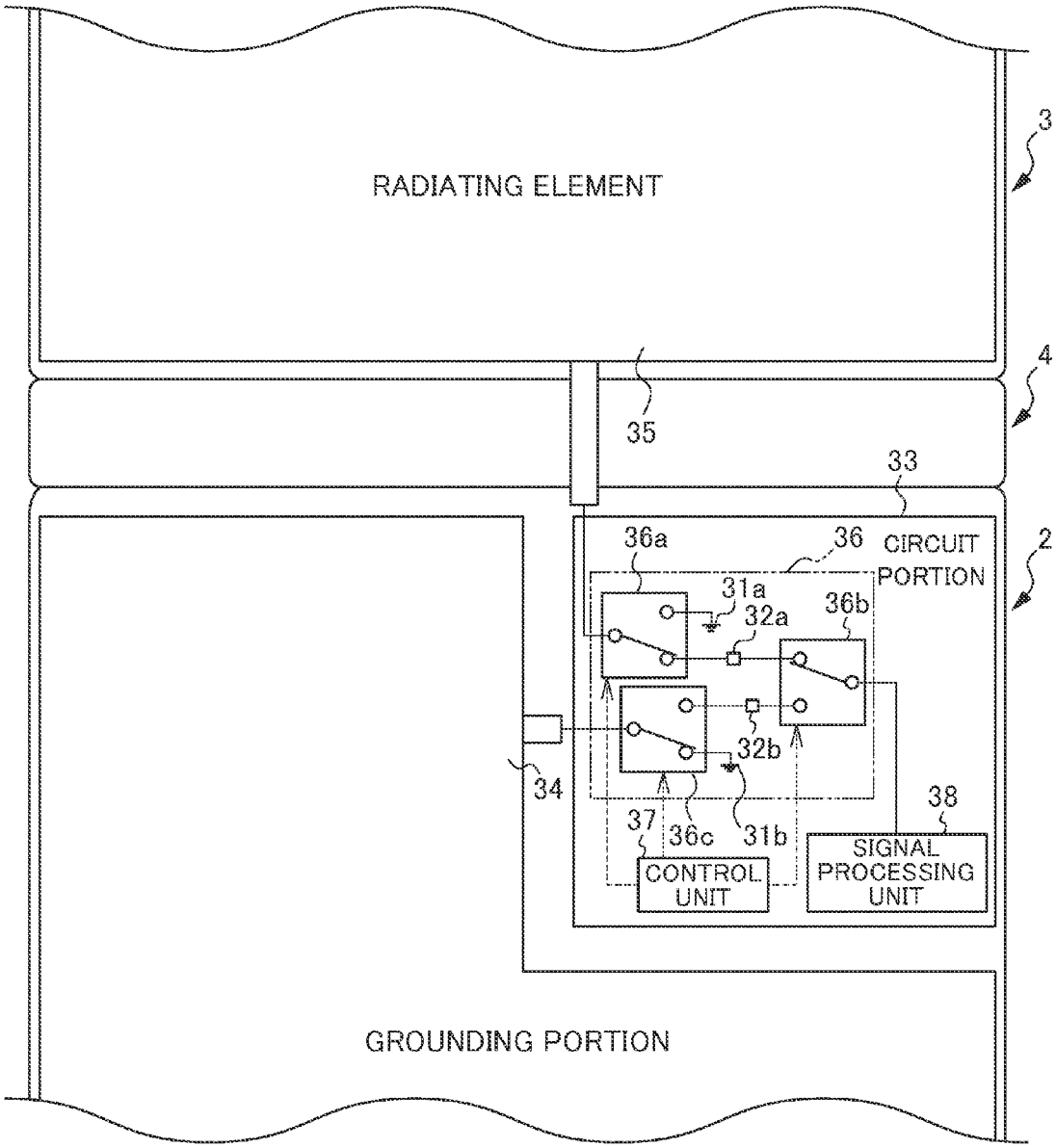
FIG. 4 is a view schematically showing a configuration of a selector portion of the cellular telephone device in a case of setting to a first state in which the display unit side body is switched a radiating element and the operation unit side body is switched to a grounding portion.

In addition, in the first state, the control unit 37 performs control so as to select the selector portion switch 36*c* so that the first conductive portion 34 and the grounding portion 31*b* are electrically connected, as shown in FIG. 4. By configuring in this way, the operation unit side body 2 realizes a function as a grounding portion of the antenna due to being connected to the grounding portion 31*b* via the first conductive portion 34.

Figure 5:
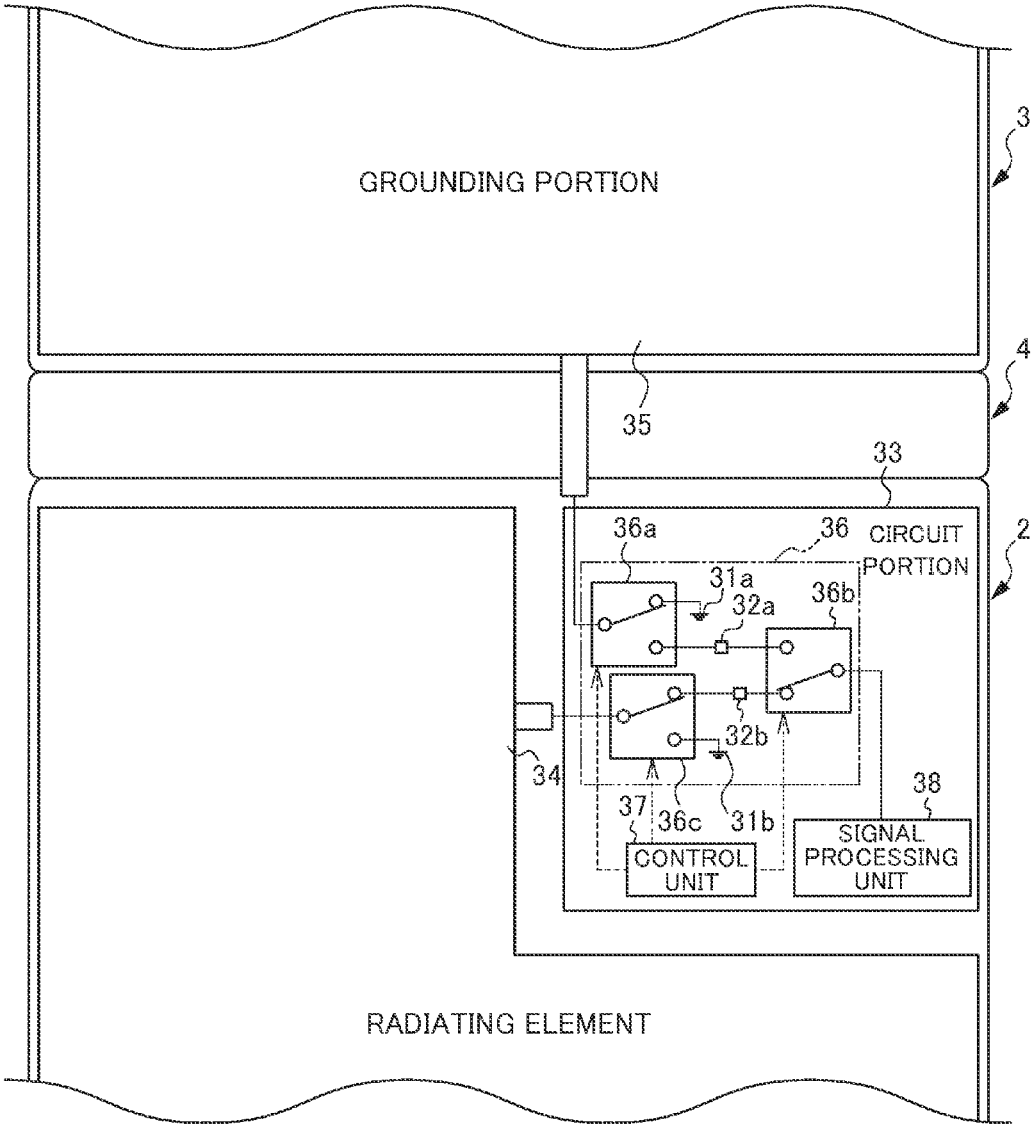
FIG. 5 is a view schematically showing a configuration of the selector portion of the cellular telephone device according to the present embodiment in a case of setting to a second state in which the operation unit side body is switched to the radiating element and the display unit side body is switched to the grounding portion.

In addition, in the second state, the control unit 37 performs control to select the selector portion switch 36*a* so that the second conductive portion 35 and the grounding portion 31*a* are electrically connected, as shown in FIG. 5. By configuring in this way, the display unit side body 3 realizes a function as a grounding portion of the antenna due to being connected to the grounding portion 31*a* via the second conductive portion 35.

In addition, in the second state, the control unit 37 performs control to select the selector portion switch 36*c* so that the first conductive portion 34 and the electric power supply part 32*b* are electrically connected, and to select the selector portion switch 36*b* so that the electric power supply part 32*b* and the signal processing unit 38 are electrically connected, as shown in FIG. 5. By configuring in this way, the second conductive portion 35 realizes a function as a radiating element of the antenna due to being connected to the signal processing unit 38 via the electric power supply portion 32.

Therefore, since the cellular telephone device 1 selects the first state or the second state according to the usage mode of the user, it is possible to control the antenna characteristics. It should be noted that, although it has been explained above that the grounding portions 31*a*, 31*b* are provided to the circuit portion 33, the first conductive portion 34 is electrically connected to the grounding portion 31*b* in the first state, and the second conductive portion 35 is electrically connected to the grounding portion 31*a* in the second state, it is not limited thereto. So long as the grounding portion 31*b* and the first conductive portion 34, and the grounding portion 31*a* and the second conductive portion 35 are the same potential, respectively, they may be capacitively connected without being directly connected together.

Figure 6:
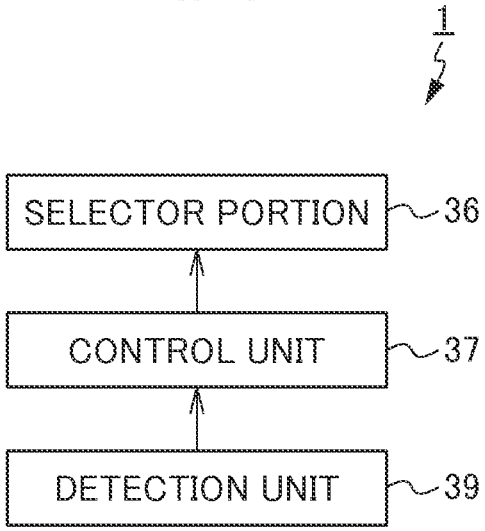
FIG. 6 is a functional block diagram showing a first configuration of the cellular telephone device according to the present embodiment.
Figure 7:
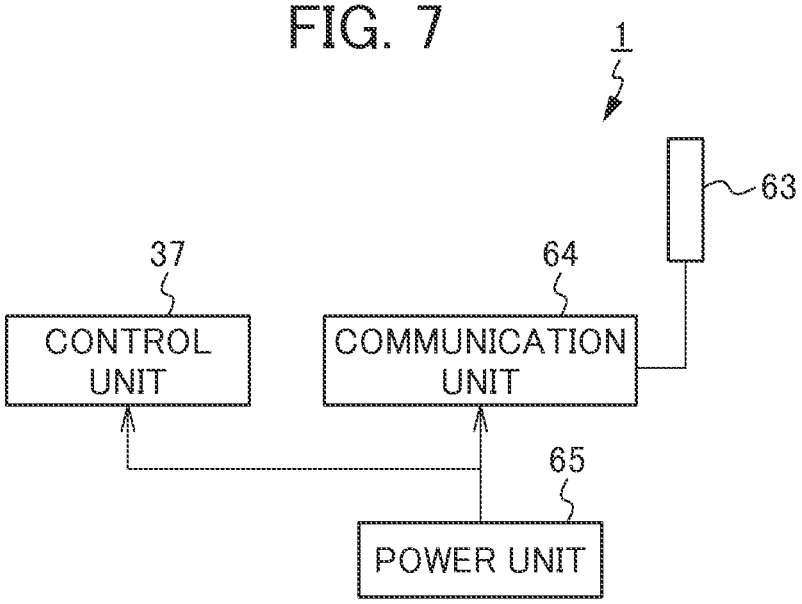
FIG. 7 is a functional block diagram showing a second configuration of the cellular telephone device according to the present embodiment.

In addition, the cellular telephone device 1 may be a configuration having a detection unit 39 that detects predetermined parameters (e.g., resonance, light level, contact state, temperature, etc.), as shown in FIG. 6. In the case of such a configuration, the control unit 37 controls selection of the first state and the second state by way of the selector portion 36 based on the predetermined parameters detected by the detection unit 39.

For example, the cellular telephone device 1 controls the selector portion 36 so as to select the second state in a case of having detected the resonance declining when controlling the selector portion 36 to operate in the first state.

By operating in this way, since the first state or the second state is selected in the cellular telephone device 1 based on the predetermined parameters, it is possible to suppress a decline in the antenna characteristics according to the usage mode.

In addition, it is preferable for the first conductive portion 34 and the second conductive portion 35 to be configured to be able to resonate with signals of a predetermined frequency band. The detection unit 39 detects a first resonance of the second conductive portion 35 with a signal of a predetermined frequency band in the first state and a second resonance of the first conductive portion 34 with a signal of a predetermined frequency band in the second state as predetermined parameters. The control unit 37 compares the first resonance and the second resonance detected by the detection unit 39, and selects the first state by way of the selector portion 36 in a case the first resonance being higher than the second resonance, and selects the second state by way of the selector portion 36 in a case of the first resonance being lower than the second resonance.

That is, the cellular telephone device 1 employs a receiving system according to the so-called diversity receiving system, detects the resonance in the first state (first resonance), then selects the second state from the first state, detects the resonance in the second state (second resonance), compares the first resonance with the second resonance, and in a case of the first resonance being higher than the second resonance, selects the first state by way of the selector portion 36, and in a case of the first resonance being lower than the second resonance, selects the second state by way of the selector portion 36.

By operating in this way, since the first state or the second state is selected based on the resonance, the cellular telephone device 1 can suppress a decline in the antenna characteristics according to the usage mode.

The cellular telephone device 1 of the present invention differs greatly from a conventional cellular telephone device of the diversity receiving system that selects the optimum receiving sensitivity by switching a plurality of antennas, in the aspect of being configured to switch the radiating element of the antenna and the grounding portion of the antenna by switching between the first state and the second state. That is, by employing a diversity receiving system using the two conductive portions of the first conductive portion 34 and the second conductive portion 35 without using another conductive portion in this way, both a reduction in the number of components and simplification of the body structure are achieved compared to a case of employing the conventional diversity receiving system.

In addition, it is preferable for the detection unit 39 to be configured to be able to detect the contact state, temperature or brightness as a predetermined parameter. In this case, the control unit 37 selects the first state by way of the selector portion 36 in a case of having detected by the detection unit 39 that the operation unit side body 2 is being contacted, the operation unit side body 2 is a temperature within a predetermined temperature range (e.g., 30° C. to 40° C.), or the periphery of the display unit side body 3 is a brightness of no more than a predetermined brightness. In addition, the control unit 37 selects the second state by way of the selector portion 36 in a case of having detected by the detection unit 39 that the display unit side body 3 is being contacted, the display unit side body 3 is a temperature within a predetermined temperature range (e.g., 30° C. to 40° C.), or the periphery of the display unit side body 3 is a brightness of no more than a predetermined brightness.

In order to detect contact by the user, the detection unit 39 arranges a detection element that is a touch sensor over the entirety of the operation unit side body 2 and the display unit side body 3, and detects contact of the user by way of the detection element. The control unit 37 selects the first state by way of the selector portion 36 in a case of having detected by the detection unit 39 that the operation unit side body 2 is being contacted. In addition, the control unit 37 selects the second state by way of the selector portion 36 in a case of having detected by the detection unit 39 that the display unit side body 3 is being contacted. It is thereby possible to separate a region receiving contact by the user from the first conductive portion 34 or the second conductive portion 35 functioning as an antenna element as much as possible, whereby a decline in antenna characteristics can be suppressed.

In addition, in order to detect contact by the user, the detection unit 39 arranges a detection element that is a temperature sensor at a predetermined portion of the operation unit side body 2 and the display unit side body 3 (portion likely to be contacted by the user), and detects a temperature change by way of the detection element. The control unit 37 selects the first state by way of the selector portion 36 in a case of having detected by the detection unit 39 that the operation unit side body 2 is a temperature within the predetermined temperature range (e.g., 30° C. to 40° C.), based on the assumption that the operation unit side body 2 is contacting by the user. In addition, the control unit 37 selects the second state by way of the selector portion 36 in a case of having detected by the detection unit 39 that the display unit side body 3 is a temperature within the predetermined temperature range (e.g., 30° C. to 40° C.), based on the assumption that the display unit side body 3 is contacting by the user. It is thereby possible to separate a region contacted by the user from the first conductive portion 34 or the second conductive portion 35 functioning as an antenna element as much as possible, whereby a decline in antenna characteristics can be suppressed.

In addition, in order to detect contact by the user, the detection unit 39 arranges a detection element of a sensor (photosensor) that detects luminance at a predetermined portion of the operation unit side body 2 and the display unit side body 3 (portion likely to be contacted by the user) and detects a change in brightness by way of the detection element. The control unit 37 selects the first state by way of the selector portion 36 in a case of having detected that the periphery of the operation unit side body 2 is a brightness no more than a predetermined brightness by way of the detection unit 39, based on the assumption that the operation unit side body 2 is contacting by the user. In addition, the control unit 37 selects the second state by way of the selector portion in a case of having detected by the detection unit 39 that the periphery of the display unit side body 3 is a brightness no more than a predetermined brightness, based on the assumption that the display unit side body 3 is contacting by the user. It is thereby possible to separate a region contacting by the user from the first conductive portion 34 or the second conductive portion 35 functioning as an antenna element as much as possible, whereby a decline in antenna characteristics can be suppressed.

By operating in this way, since the first state or second state is selected in the cellular telephone device 1 based on the contact state, temperature or brightness, it is possible to suppress a decline in the antenna characteristics according to the usage mode of the user. It should be noted that the cellular telephone device 1 may be a configuration integrally using a touch sensor, temperature sensor and photosensor.

In addition, the cellular telephone device 1 may be a configuration including a function executing unit that executes predetermined functions. In this case, it is preferable for the control unit 37 to control selection of the first state and the second state by way of the selector portion 36, based on the function being executed by the function executing unit. In this case, the control unit 37 selects the first state by way of the selector portion 36, when the mail function or Web browser function is running, when another function accompanying an operation to the key structure 40 is being executed, and, in a case of connectors able to connect with an external device such as an earphone connector or connector for data communication is provided in the cellular telephone device 1, when a cable is inserted into these connectors, based on the assumption that the operation unit side body 2 is contacting by the user. In addition, the control unit 37 selects the second state by way of the selector portion 36 when a call function is running in a state in which a cable is not inserted in the ear phone connector, based on the assumption that the display unit side body 3 is contacting by the user (ear of the user is pressing against the voice output unit 22 of the display unit side body 3). It is thereby possible to separate a region contacting by the user from the first conductive portion 34 or the second conductive portion 35 functioning as an antenna element as much as possible, whereby a decline in antenna characteristics can be suppressed. In addition, the control unit 37 may be made a configuration so as to select the first state by way of the selector portion 36 when the cellular telephone device 1 is mounted on a cradle for charging, for example.

It is preferable for the cellular telephone device 1 to have a configuration including a first antenna 63 (e.g., a CDMA antenna that performs intermittent reception in a standby state) that receives at predetermined periods (e.g., interval on the order of several hundred msec for every few seconds), a communication unit 64 that is connected to the first antenna 63 and performs predetermined reception control, and a power unit 65 that supplies electric power to the communication unit 64. In a case of being such a configuration, the control unit 37 has power supplied from the power unit 65 at a period corresponding to a predetermined period and controls selection between the first state and the second state by way of the selector portion 36.

Therefore, since control by the control unit 37 is performed during intermittent reception performed at the predetermined period, it is not necessary to supply electric power only to execute operation of the control unit 37 according to the present embodiment, and thus the cellular telephone device 1 can achieve a power savings. In addition, the cellular telephone device 1 can continuously suppress a decline in antenna characteristics due to control being performed at a predetermined period.

Figure 8:
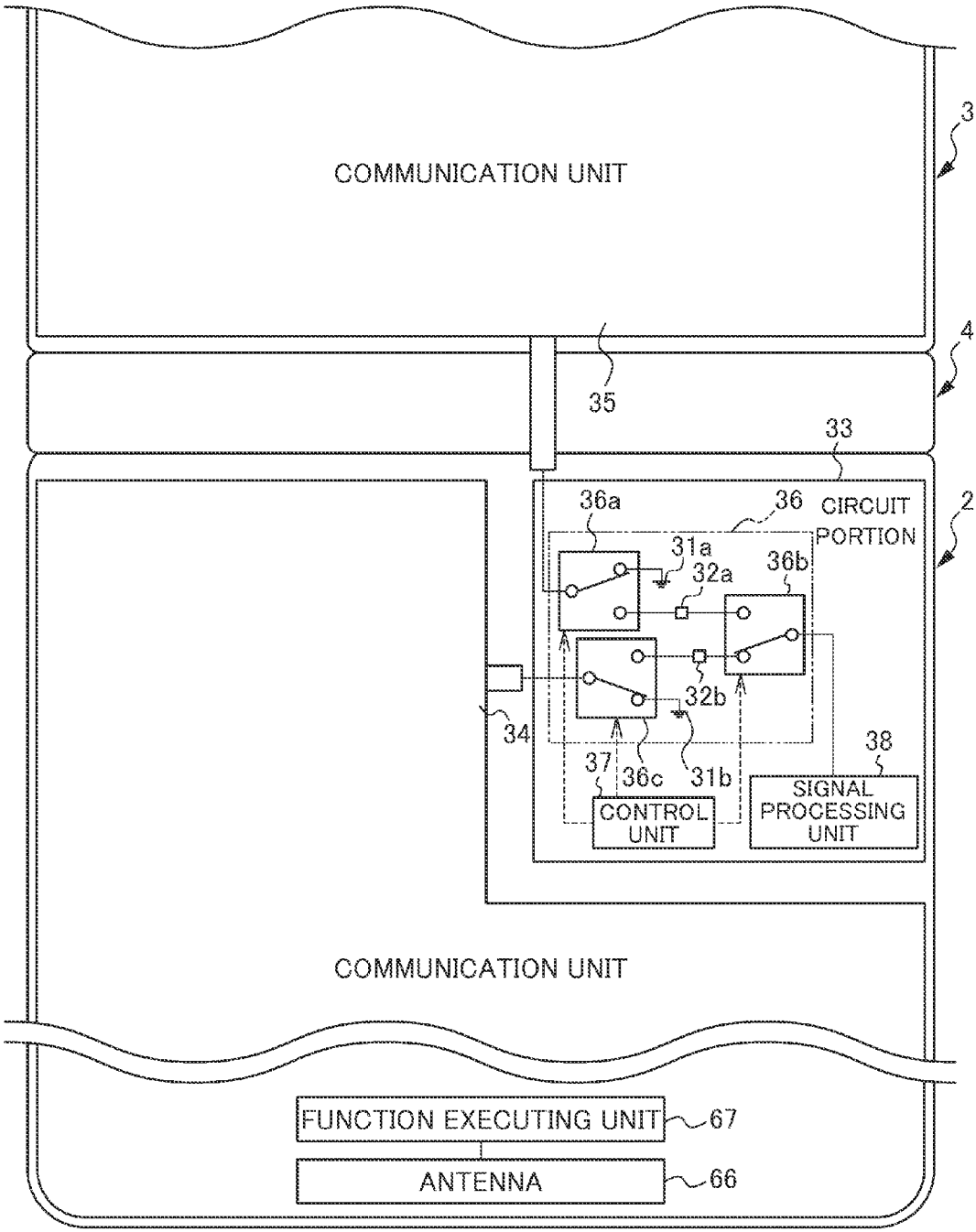
FIG. 8 is a view schematically showing a configuration of the selector portion of the cellular telephone device according to the present embodiment in a case in which the operation unit side body and the display unit side body are switched to the grounding portion.

Moreover, the cellular telephone device 1 may be a configuration including a second antenna 66, and a function executing unit 67 that executes functions relating to signals transmitted or received by the second antenna 66 (e.g., signals related to digital terrestrial broadcasting, signals related to CDMA communication, signals related to GPS (Global Positioning System) communication, signals related to wireless LAN, and signals related to RFID), as shown in FIG. 8. In a case of being such a configuration, the selector portion 36 is selected in a state (third state) to electrically connect the first conductive portion 34 and the grounding portion 31*b* as well as electrically connect the second conductive portion 35 and the grounding portion 31*a* in accordance with the control by the control unit 37. The control unit 37 switches the selector portion 36 so as to enter the third state when a function relating to signals transmitted or received by way of the second antenna 66 is executed by the function executing unit 67.

In the third state, the cellular telephone device 1 enters a state in which a function of a so-calling body antenna is not realized since the operation unit side body 2 and the display unit side body 3 both realize a function as grounding portions of the antenna.

By configuring in this way, since the function of a body antenna is stopped by the cellular telephone device 1 in a case of employing the second antenna 66, it is possible to prevent interference between the antennas. In addition, since the grounding portions of the operation unit side body 2 and the display unit side body 3 become the same potential in the third state, high frequency current flowing in the grounding portions is rectified, and thus the cellular telephone device 1 can improve the antenna characteristics of the second antenna 66. It should be noted that the second antenna 66 may be the same configuration as the aforementioned first antenna 63.

The invention claimed is:

1. A portable terminal comprising:

a first body;

a second body;

a circuit portion that is disposed in either one of the first body and the second body, and including a ground portion, an electric power supply portion, and a signal processing unit connected to the electric power supply portion;

a first conductive portion disposed in the first body;

a second conductive portion disposed in the second body;

a selector portion configured to be able to select between a first state electrically connecting the first conductive portion and the ground portion as well as electrically connecting the second conductive portion and the electric power supply portion, and a second state electrically connecting the first conductive portion and the electric power supply portion as well as electrically connecting the second conductive portion and the ground portion; and a control unit that controls selection between the first state and the second state by way of the selector portion;

a second antenna; and a function executing unit that executes functions related to a signal transmitted or received by way of the second antenna, wherein the selector portion is configured to be able to select a third state electrically connecting the first conductive portion and the ground portion as well as electrically connecting the second conductive portion and the ground portion, and wherein the control unit selects the third state by way of the selector portion when a function related to a signal transmitted or received by way of the second antenna is executed by the function executing unit.

2. A portable terminal according to claim 1, further comprising a detection unit that detects a predetermined parameter, wherein the control unit controls selection between the first state and the second state by way of the selector portion based on the predetermined parameter detected by way of the detection unit.

3. A portable terminal according to claim 2, wherein the first conductive portion and the second conductive portion are configured to be able to resonate with a signal in a predetermined frequency band, wherein the detection unit detects a first resonance sensitivity of the second conductive portion with a signal in the predetermined frequency band in the first state and a second resonance sensitivity of the first conductive portion with a signal in the predetermined frequency band in the second state as the predetermined parameter, and wherein the control unit compares the first resonance with the second resonance sensitivity detected by way of the detection unit, selects the first state by way of the selector portion in a case of the first resonance sensitivity being higher than the second resonance, and selects the second state by way of the selector portion in a case of the first resonance sensitivity being lower than the second resonance.

4. A portable terminal according to claim 2, wherein the detection unit is configured to be able to detect a contact state, temperature or brightness as the predetermined parameter, and wherein the control unit selects the first state by way of the selector portion in a case of having detected by way of the detection unit that the first body is being contacted, the first body is a temperature within a predetermined temperature range or a periphery of the second body is a brightness no more than a predetermined brightness, and selects the second state by way of the selector portion in a case of having detected by way of the detection unit that the second body is being contacted, the second body is a temperature within a predetermined temperature range or a periphery of the second body is a brightness no more than a predetermined brightness.

5. A portable terminal according to claim 1, further comprising a first antenna that intermittently receives at a predetermined period, wherein the control unit controls selection between the first state and the second state by way of the selector portion at a period corresponding to the predetermined period.

6. A portable terminal according to claim 1, further comprising a function executing unit, wherein the control unit controls selection between the first state and the second state by way of the selector portion, based on a function being executed by way of the function executing unit.

7. A portable terminal according to claim 6, further comprising an operation unit, wherein the control unit selects the first state when a function accompanying an operation to the operation unit is being executed by the function executing unit.

8. A portable terminal according to claim 1, further comprising a connector capable of connecting with an external device, wherein the control unit selects the first state when the external device is connected to the connector.

9. A portable terminal according to claim 1, further comprising a voice output unit that is disposed in the second body and outputs sound, wherein the control unit selects the second state when sound is being output by the voice output unit.

* * * * *